United States Patent [19]

Davis

[11] Patent Number: 4,474,301

[45] Date of Patent: Oct. 2, 1984

[54] TAMPER-RESISTANT AND CHILDPROOF CLOSURE

[75] Inventor: Eugene E. Davis, Essex, England

[73] Assignee: Johnsen & Jorgensen (Plastics) Ltd., London, England

[21] Appl. No.: 508,608

[22] Filed: Jun. 28, 1983

[30] Foreign Application Priority Data

Mar. 14, 1983 [GB] United Kingdom ..... 8306980
May 9, 1983 [GB] United Kingdom ..... 8312691

[51] Int. Cl.[3] ..... B65D 55/02
[52] U.S. Cl. ..... 215/220; 215/258
[58] Field of Search ..... 215/220, 256, 258, 251, 215/217

[56] References Cited

U.S. PATENT DOCUMENTS 3,944,102 3/1976 Grau ..... 215/258
4,330,067 5/1982 Deussen ..... 215/258
4,417,666 11/1983 Roberts ..... 215/256

*Primary Examiner*—George T. Hall

[57] ABSTRACT

This invention provides a Turn-Lok closure with a child-resistant press and turn feature in which the closure is also provided with a tamper-resistant means including a safety band connected to the Turn-Lok part of the closure by frangible means.

15 Claims, 3 Drawing Figures

TAMPER-RESISTANT AND CHILDPROOF CLOSURE

Figure 1:
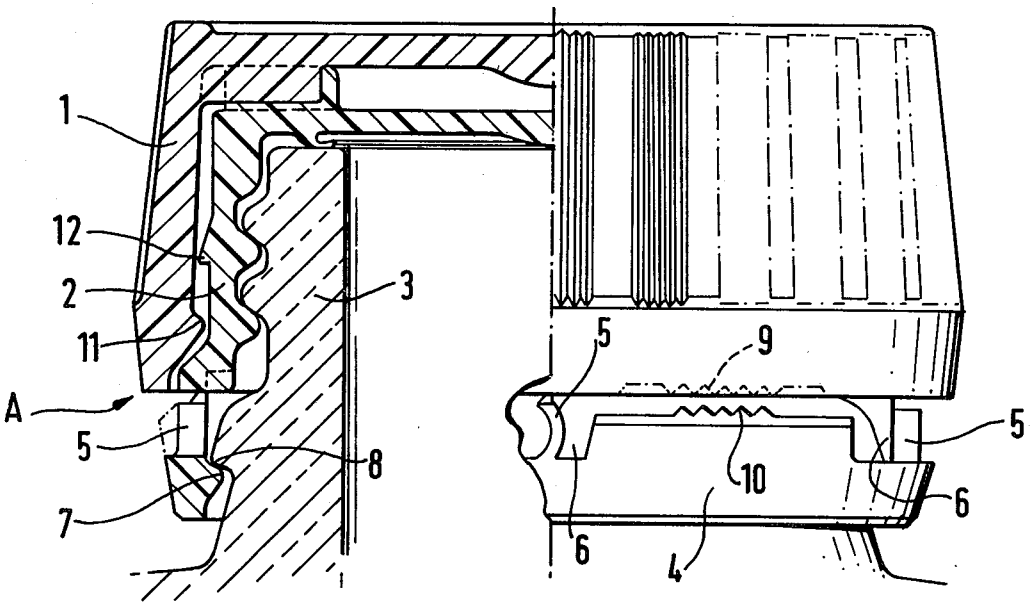

This invention is concerned with the provision of a child-resistant and tamper-resistant closure for a container.

Zeller Plastik in their British Pat. No. 1529999 have described a very effective child resistant closure which works on a press and turn principle. That closure can be screwed on to the neck of a container to close the mouth but it cannot be unscrewed without at the same time applying top pressure to the closure. The Zeller Plastic closure is now known on the market as a "Turn Lok" closure and this invention incorporates the features of the "Turn Lok" closure as described in British Pat. No. 1529999 as the child-resistant feature.

In more detail British Pat. No. 1529999 provides a child-resistant press and turn or Turn Lok closure for a container having an externally screw-threaded neck, the closure being made from plastics material and comprising a screw cap and overcap being relatively moveable both axially and angularly, projections on one of said caps and co-operating projections or recesses on or in the other of said caps, said projections or recesses having first faces on one side thereof which co-operate to transmit rotational movement from the overcap to the screw cap when the overcap is rotated in a direction to screw the closure onto the neck of a said container and second faces on the opposite sides thereof, the second face of each projection or recess of one of said caps being a cam face whereby, in use, the overcap will rotate relative to the screw cap with said projections or recesses of the different caps camming past one another when the overcap is rotated in a direction to unscrew the closure from the neck of said container unless the overcap is moved axially relative to the screw cap so that each said cam face is engaged by an edge of the second face of a projection or recess of the other cap with a force sufficient to overcome the cam action.

The Turn-Lok closure is very efficient as a child-resistant closure but it is not tamper-resistant and recent events in USA have shown that it is desirable to sell certain products e.g. food, medicaments, toilet preparations and so on in containers with tamper-resistant closures so that purchasers can see whether the container has been opened. However, once opened legitimately by the purchaser, it is essential with products hazardous to children that the package remains child-resistant. It is therefore an object of the present invention to provide a Turn-Lok closure with a tamper-resistant feature.

According to the present invention there is provided a turn-Lok closure with a child-resistant press and turn feature characterised in that the closure is also provided with tamper-resistant means including a safety band connected to the turn-Lok part of the closure by frangible means.

In one embodiment when the closuree is in position the safety band may be held down by engagement with an annular projection on an associated container so that when the closure is removed the frangible means, which connect the band to the skirt of the screw cap of the Turn-Lok part of the closure, are broken. In another similar embodiment the safety band is connected by the frangible means to the skirt of the overcap. In each embodiment the upper edge of the safety band is provided with serrations or fine teeth for co-operation with serrations or fine teeth on the skirt to which the safety band is connected.

In a third embodiment the safety band may be in the form of a tear band connected to a skirt of the Turn-Lok part of the closure and to an anchor band by lines of weakness so that the tear band may be torn away to allow the closure to be removed. In this embodiment the tear band and/or the anchor band may be shaped to engage with the container. As an additional tamper resisting feature the tear band may have a tab which is connected by frangible means to a skirt of the turn-Lok part of the closure and to the anchor band. Frangible bridge members may also be provided spanning the tear band and connected thereto and tell-tale nibs may be provided on the top of the overcap which are broken when axial pressure is applied to the overcap to move the overcap downwards to engage the projections.

The first two embodiments may be assembled and applied to the container in one screwing on operation but in the third embodiment the screw cap should be screwed on first and the overcap should be applied by downward pressure.

Figure 2:
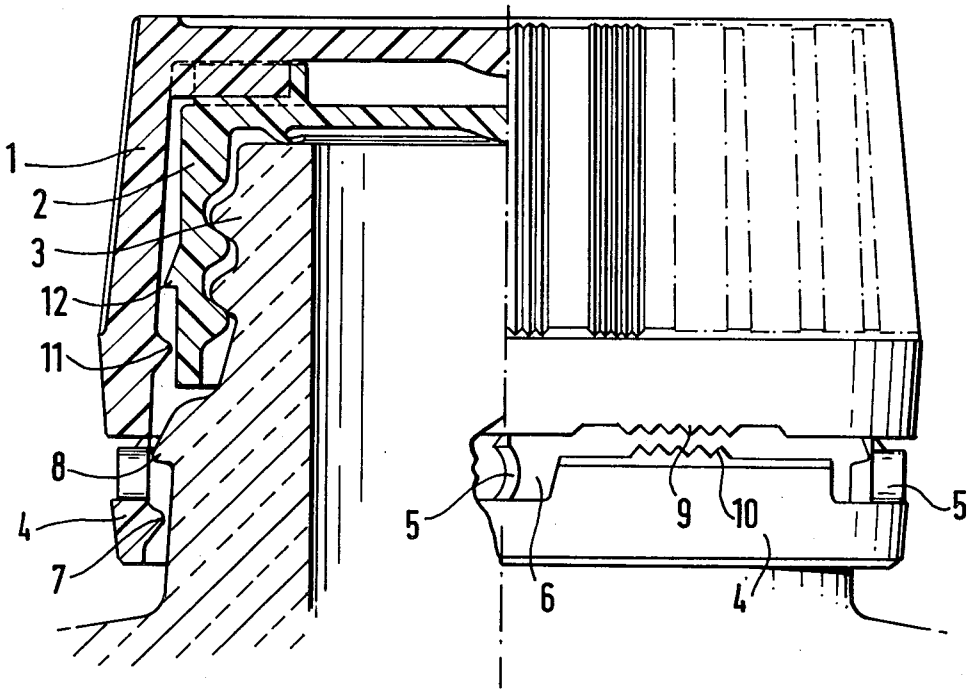
Figure 3:
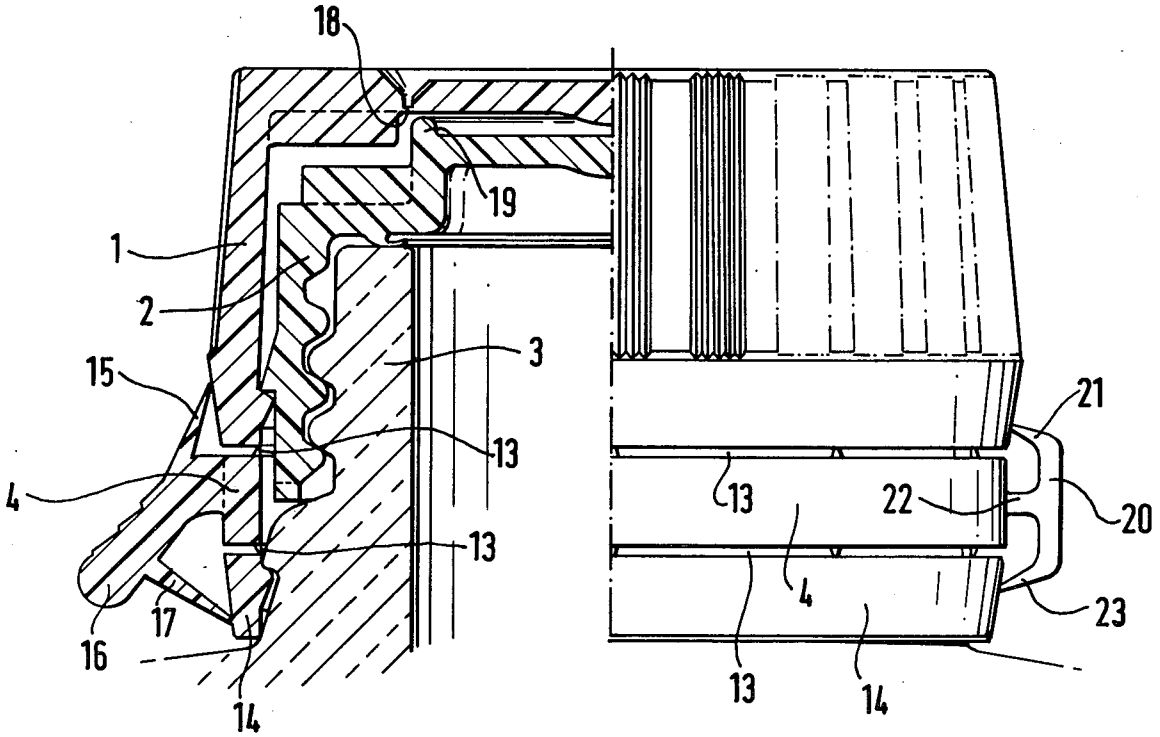

In order that the invention may be more clearly understood reference is now directed to the accompanying drawings given by way of example in which:

FIG. 1 is a sectional side elevation of a first embodiment of the invention, FIG. 2 is a sectional side elevation of a second embodiment of the invention, and FIG. 3 is a sectional side elevation of a third embodiment of the invention.

Referring first to FIG. 1, the closure may conveniently be divided into two parts, firstly a child-resistant part disposed above the line A and secondly a tamper-resistant part disposed below the line A. The child-resistant part is a standard Turn-Lok closure as described in UK Pat. No. 1529999 and comprises an overcap 1 and a screw cap 2, the screw cap 2 can move axially within the overcap 1 and when once in position on the neck of a container 3 overcap 1 can be turned freely in relation to the screw cap 2 as long as projections on the screw cap and the overcap are not caused to interlock by the application of axial pressure to the overcap. Full details of the construction and operation of the Turn-Lok closure are given in UK Pat. No. 1529999 and so further description will not be given here.

To provide a tamper-evident feature for the closure the screw cap 2 has a tamper-evident band 4 connected to the bottom of the skirt of the screw cap 2 by frangible bridge members 5 disposed in gaps 6 in the band 4. The band 4 also has an internal annular bead 7 to engage below an external annular bead 8 on the neck of the container 1. The lower edge of the skirt of the screw cap 2 has serrations or fine teeth 9 to engage with serrations or fine teeth 10 on the upper edge of the band 4 when the closure is being screwed onto the container.

In operation the closure is applied to the mouth of the container and is screwed on in the usual way. The act of screwing the closure onto the container causes the screw cap 2 to move slightly towards the band 4 due to pressure being applied to the closure and this causes the fine teeth or serrations 9 to engage positively with the fine teeth or serrations 10 on the band 4 so that the band 4 turns with the screw cap 2 and the bridge members 5 flex but do not break. At the end of the movement of the closure the bead 7 passes over the bead 8 and snaps into position below the bead 8 as shown in FIG. 1. When the closure is to be unscrewed axial downward pressure is applied to the closure so that the projections or engaging dogs with matching recesses on the screw cap 2 with the overcap 1 begin to rise. However the band 4 resists turning, because the bead 7 has settle firmly below the bead 8. The frangible bridge members 5 therefore break as the closure is being removed.

It will therefore be understood that if a closure is in position with the bridge members 5 intact that gives evidence that the closure almost certainly has not previously been removed but if the bridge members 5 are broken the closure has probably been removed and the contents of the container may have been tampered with or contaminated.

In order to minimise the risk of a child removing the overcap altogether the overcap has an annular projection 11 which, in operative position, is disposed below an annular projection 12 on the screw cap in such a position that the overcap 1 can undergo limited upward and downward movement relatively to the screw cap 2, in the manner described in greater detail in UK Pat. No. 1529999.

It will be noted that the bridge members 5 have a reduced or weakened portion at their point of connection to the skirt of the screw cap 2. An annular deformable sealing member is arranged for co-operation with the rim around the mouth of the container 3 as shown in the drawing.

The second embodiment of the invention differs from the first embodiment in that the tamper-evident band 4 is connected to the overcap 1 instead of to the screw cap 2. The same references are used in FIG. 2 as in FIG. 1, for the same parts. When the closure is applied to the container the fine teeth or serrations 9 engage with the fine teeth or serrations 10 and the band 4 turns with the screw cap 2 until the bead 7 is in the position shown in FIG. 2, below te bead 8 on the container 3. Alternatively, the screw cap 2 can be first applied and the overcap 1 can be applied by top pressure only as a secondarh sealing operations. When axial pressure is applied to the overcap 1 and the closure is turned to unscrew it, the bead 7 engages with the bead 8 as the overcap 1 is moved upwardly and the band 4 is held down so that the frangible bridge members break as in the first embodiment.

The third embodiment of the invention differs from the first embodiment in that the tamper-evident band 4 is connected to the overcap as in the FIG. 2 embodiment instead of to the screw cap. The same references are used in FIG. 3 as in FIGS. 1 and 2, for the same parts, but with the FIG. 3 embodiment the closure can only be applied in two operations. The screw cap 2 is first screwed on to the container 3 and the overcap is then pushed on over the screw cap into the position shown in FIG.3.

In FIG. 3 the tamper-evident band 4 is in the form of a tear band which is connected to the skirt of the overcap by a first line of weakness 13 and to an anchor band 14 by a second line of weakness 13. The band 4 has a first bridge member 15 connecting a tear band tab 16 to the overcap 1 and a second bridge member 17 connecting the tab 16 to the anchor band 14. As an extra safety feature frangible nibs or connections 18 are provided in the top of the overcap 1 and are so arranged that when the overcap is pressed down to start unscrewing the closure the nibs 18 are broken due to engagement of the overcap 1 with an annular pillar 19. This extra safety feature could be incorporated readily in the alternative embodiments shown.

In operation to apply the closure to the container the screw cap 2 is screwed into position on the container 3 and the overcap 1 is then pushed on to the screw cap. to remove the closure the band 4 is torn away using the tab 15 leaving the anchor band on the neck of the container, axial downward pressure is then applied to the overcap 1 to make the co-operating projections on the overcap and the screw cap to interengage. This downward movement of the overcap breaks the nibs 18 giving additional evidence that the closure may have been removed. With the co-operating projections engaged and the band 4 removed the closure can be unscrewed.

If desired a further frangible bridge member or members 20 may be provided each with an arm 21 attached to the overcap 1, an arm 22 attached to the band 4 and an arm 23 attached to the band 14.

The closure in all its embodiments is preferably made of a suitable resilient plastics material be a moulding operation. As shown in all embodiments we prefer to provide the overcap with vertical serrations. The container is preferably made of glass with a special neck profile, as shown, for co-operation with the closure, but can, of course, be made from any appropriate alternatives moulded in various plastic materials or fabricated in aluminium or sheet metal.

I claim:

1. A Turn-Lok closure with a child-resistant press and turn feature characterized in that the closure is also provided with tamper-resistant means including a safety band connected to a skirt of the Turn-Lok part of the closure by bow-shaped, frangible means.

2. A closure, for closing the mouth of a container having a screw neck finish, wherein the closure has an inner part adapted to engage with the screw neck of the container, an outer part to be applied over the inner part when in position on a container and including a depending skirt connected to a safety band in the form of anchor means by frangible means, and drive means on th inner and outer parts of the closure which are interengageable with one another in use to allow the inner part to be unscrewed from the container only when the anchor means has been separated from the depending skirt and only by relative axial engagement between the outer and inner parts during unscrewing whereby the closure is child-resistant and tamper-resistant until separation of the anchor means and is still child-resistant thereafter.

3. A closure, for closing the mouth of a container having a screw neck finish, wherein the closure has an inner part adapted to engage with the screw neck of the container, an outer part surrounding the inner part and including a depending skirt connected to a safety band in the form of anchor means by frangible means and drive means on the inner and outer parts of the closure which are interengeable with one another in use to allow the inner part to be unscrewed from the container only when the anchor means has been separated from the depending skirt and only by relative axial engagement between the outer and inner parts during unscrewing whereby the closure is child-resistant until separation of the anchor means and is still child-resistant thereafter.

4. A closure according to claim 1 wherein the safety band is held down against upward movement by engagement with an annular projection on an associated container so that when the closure is removed the frangible means which connect the band to the skirt of the screwcap of the Turn-Lok part of the closure are broken.

5. A closure according to claim 1 wherein the safety band is connected by the frangible means to a skirt of an overcap of the Turn-Lok part of the closure.

6. A closure according to claim 1 wherein the upper edge of the safety band is provided with fine teeth for co-operation with fine teeth on the skirt to which the safety band is connected.

7. A closure according to claim 1 wherein the safety band is in the form of a tear band connected to a skirt of the Turn-Lok part of the closure and to an anchor band by lines of weakness so that the tear band may be torn away to allow the closure to be removed.

8. A closure according to claim 1 wherein the screw cap of the Turn-Lok part of the closure has a tamper evident safety band connected to the bottom of the skirt of the screw cap by frangible bridge members disposed in gaps in the safety band.

9. A closure according to claim 8 wherein the band has an internal annular bead to engage below an external annular bead on the neck of an associated container.

10. A closure according to claim 8 wherein the overcap has an annular projection which, in operative position, is disposed below an annular projection on the screw cap.

11. A closure according to claim 8 wherein the bridge members have a reduced portion at their point of connection to the skirt.

12. A closure according to claim 1 wherein the overcap of the Turn-Lok part of the closure has a tamper evident safety band connected to the bottom of the skirt of the overcap by frangible bridge members disposed in gaps in the safety band.

13. A closure according to claim 1 wherein the safety band has a first bridge member connecting a tear band tab to the overcap and a second bridge member connecting the tab to an anchor band.

14. A closure according to claim 1 wherein the frangible connections are provided in the top of the overcap and are so arranged that when the overcap is pressed down to start unscrewing the closure the connections are broken.

15. A closure according to claim 1 wherein frangible bridge members are provided each with an arm attached to the overcap, one arm attached to the tear band and one arm attached to the anchor band.

* * * * *